US008402756B2

(12) United States Patent
Luce et al.

(10) Patent No.: US 8,402,756 B2
(45) Date of Patent: Mar. 26, 2013

(54) EQUAL LENGTH Y-COLLECTOR

(75) Inventors: David R. Luce, Perrysburg, OH (US); Raymond Morelli, Jr., Perrysburg, OH (US); William Brown, Toledo, OH (US); Jon W. Harwood, Toledo, OH (US)

(73) Assignee: Faurecia Exhaust Systems, Inc., Toledo, OH (US)

( * ) Notice: Subject to any disclaimer, the term of this patent is extended or adjusted under 35 U.S.C. 154(b) by 856 days.

(21) Appl. No.: 12/427,035

(22) Filed: Apr. 21, 2009

(65) Prior Publication Data

US 2009/0266066 A1 Oct. 29, 2009

Related U.S. Application Data

(60) Provisional application No. 61/047,142, filed on Apr. 23, 2008.

(51) Int. Cl.
*F02B 27/02* (2006.01)
*F01N 3/10* (2006.01)
*F01N 1/00* (2006.01)

(52) U.S. Cl. ..... 60/313; 60/299; 60/323

(58) Field of Classification Search ..... 60/299, 60/312, 313, 323, 324
See application file for complete search history.

(56) References Cited

U.S. PATENT DOCUMENTS

| | | | |
|---|---|---|---|
| 4,619,292 | A | 10/1986 | Harwood |
| 4,645,031 | A | 2/1987 | Omura et al. |
| 4,840,030 | A | 6/1989 | Ikeda et al. |
| 5,449,866 | A | 9/1995 | Moss |
| 5,473,891 | A | 12/1995 | Baxter et al. |
| 5,519,994 | A | 5/1996 | Hill |
| 5,799,395 | A | 9/1998 | Nording et al. |
| 6,633,646 | B1 | 10/2003 | Hwang |
| 6,644,437 | B1 | 11/2003 | Hayman |
| 6,799,423 | B2 | 10/2004 | Piekarski |
| 6,978,606 | B2 | 12/2005 | Loveless, II et al. |

FOREIGN PATENT DOCUMENTS

| | | |
|---|---|---|
| GB | 2309052 | 7/1997 |
| JP | 828261 | 1/1996 |

*Primary Examiner* — Kenneth Bomberg
*Assistant Examiner* — Audrey K Bradley
(74) *Attorney, Agent, or Firm* — Gerald E. Hespos; Michael J. Porco; Matthew T. Hespos

(57) ABSTRACT

An exhaust system includes first and second exhaust pipes each of which has an upstream end communicating with an engine and a downstream end. The exhaust pipes are of different lengths. A length equalizer includes an outer pipe and an inner pipe disposed within the outer pipe. Once end of the inner pipe communicates with a space between the inner and outer pipes. The longer of the two exhaust pipes communicates with the space between the inner and outer pipes of the length equalizer. The shorter of the two exhaust pipes communicates directly with the inner pipe of the length equalizer. The distance between the downstream end of the longer exhaust pipe and the inner end of the inner pipe of the length equalizer is substantially equal to the difference in length between the longer and shorter exhaust pipes.

10 Claims, 2 Drawing Sheets

EQUAL LENGTH Y-COLLECTOR

This application claims priority on U.S. Provisional Patent Appl. No. 61/047,142 filed on Apr. 23, 2008, the entire contents of which are incorporated herein by reference.

BACKGROUND OF THE INVENTION

1. Field of the Invention

The invention relates to an assembly of exhaust pipes for an automobile vehicle.

2. Description of the Related Art

The typical prior art exhaust system includes at least one manifold for collecting exhaust gas produced by the cylinders of an internal combustion engine. An exhaust pipe delivers the collected gas from the manifold to a catalytic converter where certain objectionable pollutants are converted into a less objectionable form. Another pipe extends from the catalytic converter to a muffler that attenuates noise associated with the flowing exhaust gas. At least one tail pipe then extends from the muffler to a location on the vehicle where the exhaust gas can be emitted safely.

The exhaust gas heats the components of the exhausts system, and hence requires the components of the exhaust system to be located and routed to ensure sufficient clearance from parts of the vehicle that can be damaged by heat. The exhaust pipe also must be routed to locations with sufficient space to accommodate the catalytic converter and the muffler. These controls on the location of the exhaust system components generally results in a very circuitous alignment of the exhaust pipes.

Exhaust system routing is particularly complex for V-engines, such as a V-6 or a V-8, and especially a V-engine that is mounted transversely in vehicle. The cylinders of V-engine are disposed in two angularly aligned planes and emit exhaust gases from opposite respective sides of the engine. As a result, two separate exhaust pipes must extend from spaced-apart manifolds on the V-engine, such as a front manifold and a rear manifold on a transversely mounted V-engine. A vehicle with a V-engine conceivably could have two separate exhaust systems with independent catalytic converters and mufflers. However, these systems are costly and can further complicate efforts to locate the catalytic converters and mufflers. As a result, most vehicles with V-engines have the respective exhaust pipes converge and join at a location upstream from the muffler.

The noise produced by an internal combustion engine is actually a series of repeating noises corresponding respectively to the sequential controlled explosions taking place in the cylinders of the engine. Engineers examine the loudness and frequency of noise resulting from these explosions and design an appropriate array of tubes and chambers in a muffler for attenuating the pattern of noise observed in a particular vehicle. The task of designing a muffler is more complicated if the noise from the respective explosions does not define a uniform and repetitive pattern approaching the muffler. A non-uniform pattern may cause sound waves from one explosion to partly overlap sound waves from another explosion. The additive effect of these overlapping noise patterns can complicate the acoustical tuning of the exhaust system.

Most properly tuned engines will produce uniform firing of the cylinders, and hence has the potential to direct a uniform series of noise patterns to the muffler for attenuation. However, the V-engines with a single muffler often have different exhaust gas travel lengths between the respective manifolds and the muffler. Engineers can try to route the exhaust types for a V-engine to achieve substantially equal lengths between the respective manifolds and the point where the exhaust pipes converge. However, the engine compartment of a typical vehicle is extremely crowded and engineers generally do not have the luxury of routing the exhaust pipes from a V-engine in a way that will ensure substantially equal lengths.

U.S. Pat. No. 5,473,891 is assigned to the assignee of the subject invention and teaches the use of a stamped-formed connector in an effort to equalize the lengths of two exhaust pipes. More particularly, the connector of U.S. Pat. No. 5,473,891 has three plates stamped-formed to define an array of channels. The plates are secured in face-to-face relationship with one another so that the channels define an array of tube-like passages between adjacent plates. The passages are disposed to define two inlets for connection with the respective exhaust pipes. The passages join at a selected location in the connector and extend to a single outlet. The array of channels in the plates is formed so that one of the passages exceeds the length of the other passage by a difference between the respective lengths of the exhaust pipes. As a result, the stamped-formed connector will equalize the exhaust gas travel distance between the respective manifolds and the muffler.

Stamped-formed exhaust components can achieve several cost and manufacturing efficiencies and can be designed to fit into the limited available space in the engine compartment and beneath the vehicle. However, the design options available with the stamped-form technology of U.S. Pat. No. 5,473,891 cannot easily accommodate significant differences in the lengths of two exhaust pipes. More particularly, there generally is not a sufficient volume of space available in the engine compartment or beneath the vehicle for one array of channels in a stamp formed connector to make up a significant difference in the lengths of two exhaust pipes. Furthermore, a very circuitous arrangement of channels in a stamped-formed connector could create a back-pressure with an adverse effect on engine performance and fuel efficiency.

Accordingly, it is an object of the subject invention to provide an assembly for equalizing the exhaust gas travel lengths of two exhaust pipes.

Another object of the subject invention is to provide an assembly that enables the exhaust gas travel length to be equalized without utilizing a large volume of space in the engine compartment or under the vehicle.

It is a further object of the subject invention is to provide an assembly for equalizing the effective length of two exhaust pipes without a circuitous array of pipes that could increase back pressure in the flowing exhaust gas.

SUMMARY OF THE INVENTION

The invention relates to an exhaust gas pipe assembly. The exhaust gas pipe assembly includes first and second exhaust pipes. Each of the exhaust pipes has an upstream end, a downstream end and a length extending between the upstream and the downstream ends. The minimum required length of the first exhaust pipe exceeds the minimum required length of the second exhaust pipe. The assembly further includes an outer pipe that communicates with the downstream ends of the two exhaust pipes. However, the downstream ends of the two-exhaust pipes communicate with the outer pipe at different longitudinal positions along the outer pipe. The positions of the downstream ends of the first and second exhaust pipes relative to the outer pipe are selected to equalize the effective lengths of the first and second exhaust pipes.

In one embodiment, the outer pipe has opposite upstream and downstream ends. The downstream end of the first exhaust pipes may communicate with the upstream end of the outer pipe. However, the downstream end of the second exhaust pipe may communicate with a location between the upstream and the downstream ends of the outer pipe. The effective length of the first exhaust pipe corresponds to the distance between the upstream end of the first exhaust pipe and the downstream end where the first exhaust pipe communicates with the cross-sectionally larger outer pipe of the system. However, the length of the shorter second exhaust pipe is the distance between the upstream end of the second exhaust pipe and the downstream end of the second exhaust pipe disposed in the outer pipe and between the upstream and downstream ends of the outer pipe. Thus, the effective acoustical lengths of the two exhaust pipes can be made substantially equal.

The outer pipe and portions of the second exhaust pipe therein may be linear or may be curved relative to one another. Preferably, the outer pipe is substantially concentric with the portion of the second exhaust pipe disposed therein.

The first and second exhaust pipes may extend continuously from the manifolds of the engine and the catalytic converter may be downstream from the outer pipe. However, in some embodiments, first and second catalytic converters may be disposed upstream of the outer pipe. Thus, the first exhaust pipe may include a first inlet pipe extending from a first manifold to the upstream end of the catalytic converter and a first intermediate pipe extending from the downstream end of the catalytic converter to the upstream end of the outer pipe. The second exhaust pipe may include a second inlet pipe extending from the second manifold to the upstream end of the catalytic converter and a second intermediate pipe extending from the downstream end of the catalytic converter to a location between the upstream and downstream ends of the outer pipe.

The outer pipe may be formed from a plurality of components assembled to one another. For example, the outer pipe may have an upstream header stamp formed to include first and second inlets for communicating respectively with first and second exhaust pipes. The outer pipe may further include a downstream header for reducing the diameter from a relatively large diameter at the outer pipe to a smaller diameter for communicating with an outlet pipe that extends to the muffler.

DETAILED DESCRIPTION OF THE PREFERRED EMBODIMENT

Figure 1:
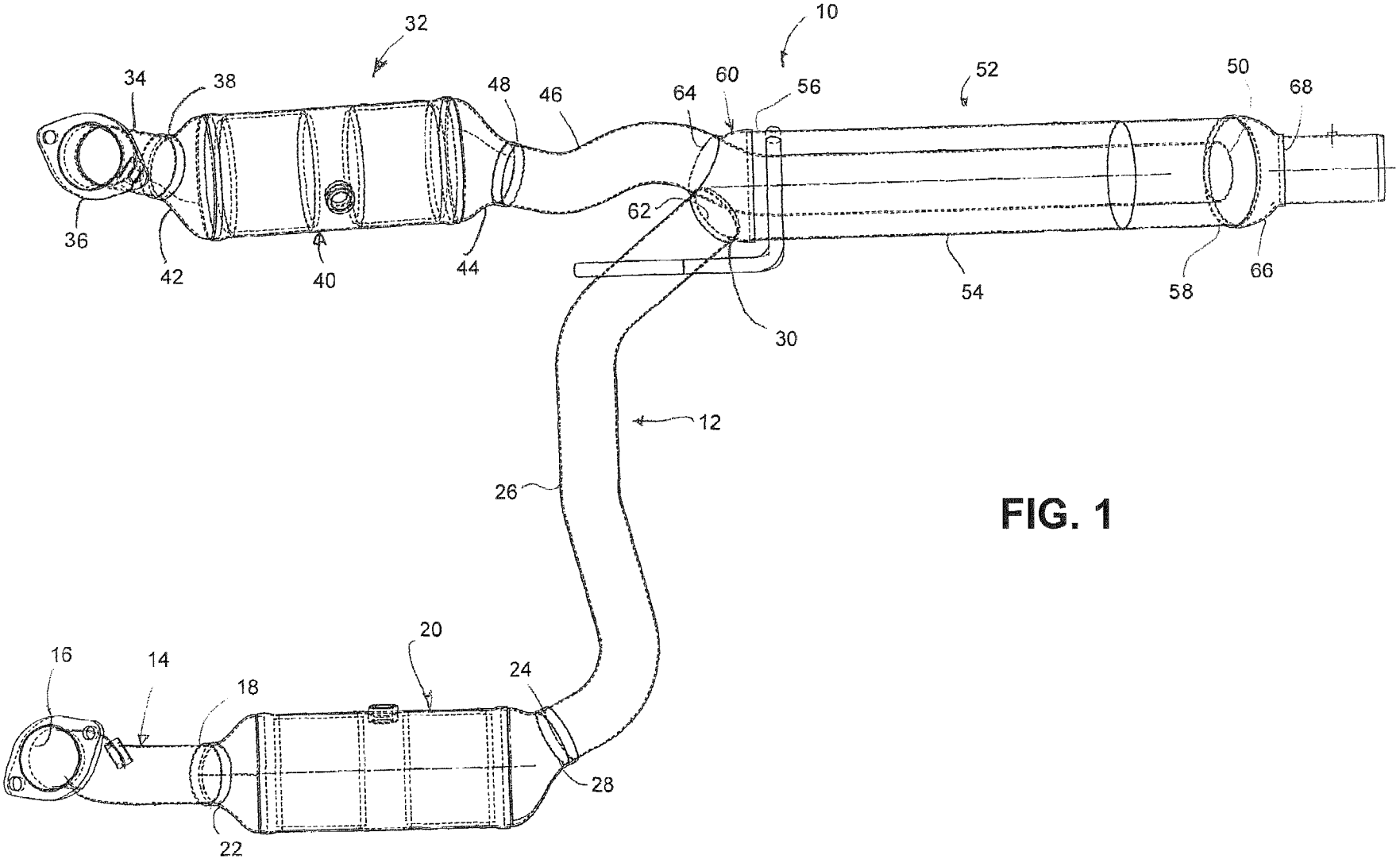
FIG. 1 is a schematic view of an exhaust system assembly in accordance with a first embodiment of the invention.

An exhaust system assembly in accordance with the invention is identified generally by the numeral 10 in FIG. 1. The exhaust system assembly includes a first exhaust pipe subassembly identified generally by the numeral 12. The first exhaust pipe subassembly 12 includes a first inlet pipe 14 having an upstream end 16 and a downstream end 18. The upstream end 16 of the first inlet pipe 14 is configured for connection to a first manifold of an engine (not shown). In the illustrated embodiment, the upstream end 16 of the first inlet pipe 14 is configured as a flange or is attached to a flange. However, other possible configurations can be provided for the upstream end 16 of the first inlet pipe 14.

The first exhaust pipe subassembly 12 also includes a first catalytic converter 20 having an upstream end 22 and a downstream end 24. The upstream end 22 of the first catalytic converter 20 is connected securely to the downstream end 18 of the first inlet pipe 14.

The first exhaust pipe subassembly 12 further includes a first intermediate pipe 26 having an upstream end 28 and a downstream end 30. The upstream end 28 of the first intermediate pipe 26 is connected securely to the downstream end 24 of the first catalytic converter 20.

The exhaust system assembly 10 further includes a second exhaust pipe subassembly identified generally by the numeral 32. The second exhaust pipe subassembly 32 includes a second inlet pipe 34 having an upstream end 36 and a downstream end 38. The upstream end 36 of the second inlet pipe 34 is configured for connection to a second manifold of an engine.

The second exhaust pipe subassembly 32 also includes a second catalytic converter 40 having an upstream end 42 and a downstream end 44. The upstream end 42 of the second catalytic converter 40 is connected securely to the downstream end 38 of the second inlet pipe 34.

The second exhaust pipe subassembly 32 further includes a second intermediate pipe 46 having an upstream end 48 and a downstream end 50. The upstream end 48 of the second intermediate pipe 46 is connected securely to the downstream end 44 of the second catalytic converter 40.

The exhaust system assembly 10 further includes a length equalizer assembly 52 having an outer pipe 54 with opposite upstream and downstream ends 56 and 58 respectively. The outer pipe 54 is cross-sectionally larger than the first and second intermediate pipes 26 and 46. The length equalizer assembly 52 further includes an upstream header 60 mounted to the upstream end 56 of the outer pipe 54. The upstream header 60 includes first and second openings 62 and 64 extending therethrough. The first opening 62 in the upstream header 60 is connected securely to the downstream end 30 of the first intermediate pipe 26. The second opening 64 of the upstream header 60 accommodates the second intermediate pipe 46 and is connected securely to a position along the length of the second intermediate pipe 46. The length equalizer assembly 52 further includes a downstream header 66 securely connected to the downstream end 58 of the outer pipe 54. The downstream header 66 includes an outlet opening 68 and an outlet pipe 70 is connected securely to the downstream opening 68 of the downstream header 66.

The downstream end 50 of the second intermediate pipe 46 is between the upstream and downstream ends 56 and 58 of the outer pipe 54, and in the illustrated embodiment is at a position near the downstream end 58 of the outer pipe 54.

The first inlet pipe 14, the first intermediate pipe 26, the second inlet pipe 34 and the second intermediate pipe 46 each have at least one bend therein. The shapes and locations of the bends are selected to enable the respective pipes to traverse the crowded space in the engine compartment of the vehicle and toward the underside of the vehicle. Additionally, the respective bends reflect that fact that the exhaust system assembly 10 is used with a V-engine, and possibly a V-engine mounted transversely in the vehicle. With this situation, the exhaust pipe subassemblies 12 and 32 are extremely unlikely to be disposed symmetrically in the vehicle and are likely to define different developed lengths between the respect exhaust manifolds and the muffler. In this context, the term "developed lengths" refers to the length as measured along the bent centerline of the respective pipe.

As noted above, different lengths for two exhausts pipes that communicate with a single muffler can complicate tuning efforts. The exhaust system assembly 10 illustrated in FIG. 1 substantially avoids those complications by having the downstream end 30 of the first intermediate pipe 26 communicate with the upstream end 56 of the length equalizer assembly 52, while the downstream end 50 of the second intermediate pipe 46 communicates with a location near the downstream end of the length equalizer assembly 52. The developed length of the portion of the second intermediate pipe 46 disposed within the outer pipe 54 is substantially equal to the difference between the developed length of the entire first exhaust pipe subassembly 12 and the portion of the second exhaust pipe subassembly 32 externally of the length equalizer assembly 52.

The first exhaust pipe subassembly 12 behaves acoustically in accordance with the developed length between the upstream end 16 of the first inlet pipe 14 and the downstream end 30 of the first intermediate pipe 26. The portion of the outer pipe 54 surrounding downstream portions of the second intermediate pipe 42 does not contribute to the effective acoustical length of the first exhaust pipe subassembly 12. However, the entire length of the second exhaust pipe subassembly 32 from the upstream end 36 of the second inlet pipe 34 to the downstream end 50 of the second intermediate pipe 46 defines the total acoustical length of the second exhaust pipe subassembly 32. As a result, the effective acoustical lengths of the first and second exhaust pipe assemblies 12 and 32 are essentially equal, and any adverse acoustical effect that might be caused by having two different length exhaust pipes is avoided or minimized.

Figure 2:
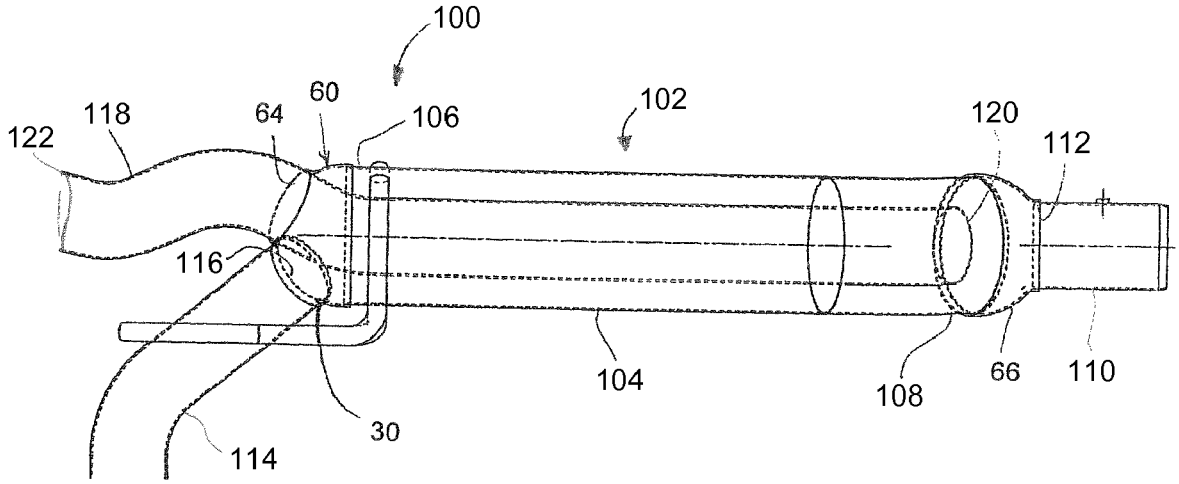
FIG. 2 is a schematic view of an exhaust system assembly in accordance with a second embodiment of the invention.

The principle of positioning one pipe with another pipe to achieve equal acoustical lengths can be carried out with arrangements of the pipes other than the arrangement shown in FIG. 1. More particularly, FIG. 2 shows an exhaust system assembly 100 with many of the same components as the assembly 10 of FIG. 1. However, the exhaust system assembly 100 of FIG. 2 has a length equalizer assembly 102 with an outer pipe 104 that has opposite first and second ends 106 and 108. A first exhaust pipe 110 has an upstream end that communicates with a first plurality of cylinders of the engine (not shown) and a downstream end 112 that communicates with the first end 106 of the outer pipe 104 of the length equalizer assembly 102. A second exhaust pipe 114 has an upstream end that communicates with a second plurality of cylinders of the engine (not shown) and a downstream end 116 that communicates with the second end 108 of the outer pipe of the length equalizer assembly 102. The exhaust system assembly 100 further has a tail pipe 118 that passes through the second end of the outer pipe 104 of the length equalizer assembly 102. The tail pipe 118 has an upstream end 120 disposed in the outer pipe 104 of the length equalizer assembly 102 at a selected position between the first and second ends 106 and 108 thereof. The tail pipe 118 also has a downstream end 122 disposed externally of the length equalizer assembly 102, and preferably at a position near the end of the vehicle.

The first exhaust pipe 110 has an effective acoustical length that extends from the engine to the first end 104 of the length equalizer assembly 102. The second exhaust pipe 114 has an effective acoustical length that extends from the engine to the upstream end 120 of the tail pipe 118. Thus, the effective acoustical length of the second exhaust pipe 114 is increased by the distance within the outer pipe 104 of the length equalizer assembly 102 between the downstream end of the second exhaust pipe 114 and the upstream end 120 of the tail pipe 118. This distance between the downstream end of the second exhaust pipe 114 and the upstream end 120 of the tail pipe 118 is adjusted to substantially equalize the effective acoustical lengths of the first and second exhaust pipes 110 and 114.

While the invention has been described with respect to certain preferred embodiments it is apparent that various changes can be made without departing from the scope of the invention defined by the appended claims. For example, the following optional configurations are encompassed by the scope of the invention.

The first embodiment shows two catalytic converters incorporated into the exhaust pipes between the engine and the length equalizer assembly. However, one catalytic converter can be disposed downstream from the length equalizer assembly. This optional embodiment reduces the costs associated with the catalytic converters. Additionally, the pipe-within-a pipe arrangement of the length equalizer assembly provides insulation that retains the exhaust heat for achieving a more rapid light off of the catalyst.

The second embodiment schematically illustrates the two exhaust pipes communicating with opposite ends of the outer pipe of the length equalizer assembly. However, the second exhaust pipe can communicate with a location on the outer pipe of the length equalizer assembly between the first and second ends.

Both embodiments illustrate the inner pipe of the length equalizer assembly as having a solid peripheral wall. However, the inner pipe of the length equalizer assembly can have perforations, louvers or the like for contributing to acoustical tuning.

What is claimed is:

1. An exhaust system assembly comprising:

an exhaust gas collector having an outer pipe with opposite first and second ends and an inner pipe disposed within the outer pipe so that an inner space is defined between the inner and outer pipes, the inner space being free of pipes therein other than the inner pipe, the inner pipe having a first end opening into the inner space between the inner and outer pipes and a second end opposite the first end;

a first pipe for delivering exhaust gas from an engine to the exhaust gas collector, the first pipe communicating directly with the inner space of the outer pipe of the exhaust gas collector;

a second pipe for delivering exhaust gas from an engine to the exhaust gas collector, the second pipe communicating directly with the inner space of the outer pipe of the exhaust gas collector at a location spaced from the first pipe; and a third pipe unitary with and communicating with the second end of the inner pipe of the exhaust gas collector, the third pipe being a tail pipe for emitting the exhaust gas delivered to the exhaust gas collector by the first and second pipes, wherein:

a centerline pipe length extending along the second pipe from the engine to the first end of the inner pipe of the exhaust gas collector substantially equals a centerline pipe length of the first pipe from the engine to the inner space of the exhaust gas collector.

2. The exhaust system of claim 1, wherein the first pipe communicates with the inner space of the outer pipe of the exhaust gas collector at a location between the first and second ends of the inner pipe, the first pipe being shorter than the second pipe by a distance substantially corresponding to a distance between the first end of the inner pipe of the exhaust gas collector and a location on the outer pipe of the exhaust gas collector where the first exhaust pipe communicates with the inner space between the inner and outer pipes.

3. The exhaust system of claim 1, wherein the inner pipe is supported substantially concentrically within the outer pipe.

4. The exhaust system of claim 1 further comprising at least one catalytic converter.

5. The exhaust system of claim 4, wherein the at least one catalytic converter comprises two catalytic converters that communicate respectively with the first and second pipes.

6. An exhaust system comprising:

a first exhaust pipe having an upstream end communicating with an engine and a downstream end spaced from the upstream end by a first distance measured along a centerline of the first exhaust pipe;

a second exhaust pipe having an upstream end communicating with the engine and a downstream end spaced from the upstream end by a second distance measured along the centerline of the second exhaust pipe, the second distance being less than the first distance by a distance differential; and an exhaust gas collector having an outer pipe, an inner pipe disposed at least partly within the outer pipe and an inner space between the inner and outer pipes, the inner pipe having a first end opening into the inner space between the inner and outer pipes and a second end opposite the first end, a tail pipe unitary with and communicating with the second end of the inner pipe of the exhaust gas collector and extending to a location external of the exhaust gas collector, the inner space being free of pipes other than the inner pipe and the first and second exhaust pipes, a centerline pipe length extending along the second pipe from the engine to the first end of the inner pipe of the exhaust gas collector substantially equals a centerline pipe length of the first pipe from the engine to the inner space of the exhaust pas collector.

7. The exhaust system of claim 6 further comprising first and second catalytic converters communicating respectively with the first and second exhaust pipes.

8. An exhaust system comprising:

a first exhaust pipe having an upstream end communicating with an engine and a downstream end spaced from the upstream end by a first distance measured along a centerline of the first exhaust pipe;

a second exhaust pipe having an upstream end communicating with the engine and a downstream end spaced from the upstream end by a second distance measured along the centerline of the second exhaust pipe, the second distance being less than the first distance by a distance differential;

a tail pipe having opposite upstream and downstream ends; and an exhaust gas collector pipe having opposite first and second ends and an inner space between the ends, the downstream end of the first exhaust pipe communicating with the inner space of the exhaust gas collector pipe at a location substantially adjacent the first end of the exhaust gas collector pipe, the tail pipe extending through the second end of the exhaust gas collector pipe so that the upstream end of the tail pipe is between the first and second ends of the exhaust gas collector pipe, the second exhaust pipe communicating with the inner space of the exhaust gas collector pipe at a location in proximity to the second end of the exhaust gas collector pipe so that a distance between the downstream end of the second exhaust pipe and the upstream end of the tail pipe is substantially equal to the distance differential between the first and second exhaust pipes, wherein the tail pipe is the only pipe in the inner space.

9. The exhaust system of claim 8, wherein the upstream end of the tail pipe is positioned substantially concentrically within the exhaust gas collector pipe.

10. An exhaust system comprising:

a first exhaust pipe having an upstream end communicating with an engine and a downstream end spaced from the upstream end by a first distance measured along a centerline of the first exhaust pipe;

a second exhaust pipe having an upstream end communicating with the engine and a downstream end spaced from the upstream end by a second distance measured along the centerline of the second exhaust pipe, the second distance being less than the first distance by a distance differential;

a tail pipe having opposite upstream and downstream ends; and an exhaust gas collector pipe having opposite first and second ends and an inner space between the ends, the downstream end of the first exhaust pipe communicating with the inner space of the exhaust gas collector pipe at a location substantially adjacent the first end of the exhaust gas collector pipe, the tail pipe extending through the second end of the exhaust gas collector pipe so that the upstream end of the tail pipe is between the first and second ends of the exhaust gas collector pipe, the second exhaust pipe communicating with the inner space of the exhaust gas collector pipe at a location in proximity to the second end of the exhaust gas collector pipe so that a distance between the downstream end of the second exhaust pipe and the upstream end of the tail pipe is substantially equal to the distance differential between the first and second exhaust pipes, wherein the tail pipe and the first and second exhaust pipes are the only pipes disposed in or communicating with the inner space.

* * * * *